United States Patent [19]

Nagai et al.

[11] 4,134,758

[45] Jan. 16, 1979

[54] TITANIUM ALLOY WITH HIGH INTERNAL FRICTION AND METHOD OF HEAT-TREATING THE SAME

[75] Inventors: Nobuyuki Nagai, Kobe; Yasuo Moriguchi, Nishinomiya; Yoshimasa Itoh, Kobe; Shoji Ueda, Nagasaki; Yorimasa Takeda, Isahaya; Akira Hiromoto, Nagasaki, all of Japan

[73] Assignees: Mitsubishi Jukogyo Kabushiki Kaisha; Kobe Steel, Ltd., both of Kobe, Japan

[21] Appl. No.: 790,944

[22] Filed: Apr. 26, 1977

[30] Foreign Application Priority Data

Apr. 28, 1976 [JP] Japan ..... 51-49056

[51] Int. Cl.[2] ..... C22C 14/00; C21D 1/00

[52] U.S. Cl. ..... 75/175.5; 148/133

[58] Field of Search ..... 75/175.5; 148/32, 32.5, 148/133, 11.5 F

[56] References Cited

U.S. PATENT DOCUMENTS 2,754,204 7/1956 Jaffee et al. ..... 75/175.5

2,804,409 8/1957 Kessler et al. ..... 75/175.5 X 2,918,367 12/1959 Crossley et al. ..... 75/175.5

FOREIGN PATENT DOCUMENTS 772339 3/1957 United Kingdom ..... 75/175.5

OTHER PUBLICATIONS

*Mechanical Metallurgy, Deiter, Jr., McGraw-Hill Book Co., N.Y., 1961, pp. 232–233.*

*Primary Examiner*—R. Dean

*Assistant Examiner*—Peter K. Skiff

*Attorney, Agent, or Firm*—Holman & Stern

[57] ABSTRACT

A titanium alloy having a high degree of internal friction and suitable for rotating blades of turbomachines is composed of 5.5 – 6.75% Al, 1 – 5% V, 1 – 5% Mo, V plus Mo being greater than or equal to 5%, and the balance Ti and usual impurities, all by weight. A method of heat-treating the alloy comprises maintaining the same at a temperature not lower than 125° C below its $\beta$ transformation point for a predetermined period of time and then rapidly cooling the alloy.

2 Claims, 3 Drawing Figures

TITANIUM ALLOY WITH HIGH INTERNAL FRICTION AND METHOD OF HEAT-TREATING THE SAME

BACKGROUND OF THE INVENTION

This invention relates to a titanium alloy with a high internal friction advantageously suited for the manufacture of rotating blades, particularly of large sizes or for highspeed operations, as those of steam turbines, for example, and also relates to a method of heat-treating the alloy for further improvements in the vibration damping capacity and thermal stability of the same.

For the rotating blades of steam turbines, for example, the fatigue failure due to vibrations is a serious problem. In precluding the failure, prevention of the resonances and damping of the vibrations play effective roles. However, vibration modes of steam turbine blades are so complex that designing such blades completely free of resonance is next to impossible. In what way the vibrations should be damped is, therefore, a problem of prime importance.

Possible factors suppressing the vibrations of rotating blades are aerodynamic, root, mechanical, and material dampings. While the contributions of these factors to the total damping have been variously estimated, it is said that, as often as not, the material damping plays a major role. In fact, the 13Cr-Mo steel and other materials with high degrees of internal friction are in many cases used in constructing steam turbine blades. Generally, titanium alloys, which have high specific strengths, are considered useful in manufacturing steam turbine blades, particularly for high-speed running or of large sizes, so as to reduce the loads on the rotors. Especially, the Ti-6Al-4V alloy is the widest used of all titanium-base alloys (accounting for more than about 70% of the total titanium alloy usage). Its promising applications include the rotating blades for steam turbines and other rotary machines, and it has already been used to some extent in that field.

However, the ordinary Ti-6Al-4V alloy of commerce conventionally heat-treated, that is, annealed or quench-aged has a considerably low degree of internal friction, as compared with the 13Cr-Mo steel and the like actually in use for the manufacture of the majority of steam turbine blades. With the former, no vibration-diminishing effect by material damping can be expected.

With these in view, we made diversified investigations and, as a result, found that a remarkable improvement in the internal friction property is made possible by rapidly cooling an $\alpha+\beta$ titanium alloy from a proper temperature in the $\alpha+\beta$ phase temperature range. The invention is covered by our copending Japanese Patent Application No. 3072/74.

Nevertheless, the $\alpha+\beta$ alloy, for example, of the Ti-6Al-4V composition, shows a decrease of its internal friction and becomes thermally instable upon heating at over 100° C. for an extended period of time. Partly for this reason and partly because higher absolute values of internal friction are more helpful in preventing fatigue failure, the titanium alloys with further increased absolute internal friction values have been called for in the art.

Previously we found that the internal friction of a titanium alloy can be increased by rapidly cooling the alloy from a certain temperature range and thereby bringing the metastable $\beta$ phase down to room temperature. In achieving this effect the presence of an isomorphous $\beta$ stabilizer in the titanium alloy appears to play a major role. Through tests with the Ti-6Al-4V alloy that contains vanadium, one of the $\beta$ stabilizers, we confirmed that the alloy attains increased internal friction on rapid cooling from a temperature in the $\alpha+\beta$ phase range.

Our subsequent studies on the addition of another isomorphous $\beta$ stabilizer, molybdenum, to the ordinary Ti-6Al-4V alloy have resulted in the present invention.

SUMMARY OF THE INVENTION

The object of the present invention is to provide a titanium alloy suitable for rotating blades of turbomachines with a higher internal friction than the conventional alloys and having excellent thermal stability, and also to provide a method of heat-treating the alloy for further improvements in both internal friction and thermal stability.

According to the invention, a titanium alloy having a high degree of internal friction is provided which is composed of (all by weight) 5.5–6.75% Al, 1–5% V, 1–5% Mo, V plus Mo being greater than or equal to 5%, and the balance Ti and usual impurities.

Also, according to the invention, a method of heat-treating the above-mentioned alloy is provided which comprises maintaining the same at a temperature not lower than 125° C. below its $\beta$ transformation point for a predetermined period of time and then rapidly cooling the alloy.

BRIEF DESCRIPTION OF THE DRAWINGS

The present invention will be more fully described below with illustration by examples thereof and with reference to the accompanying drawings, in which.

DETAILED DESCRIPTION OF PREFERRED EMBODIMENTS

Figure 1:
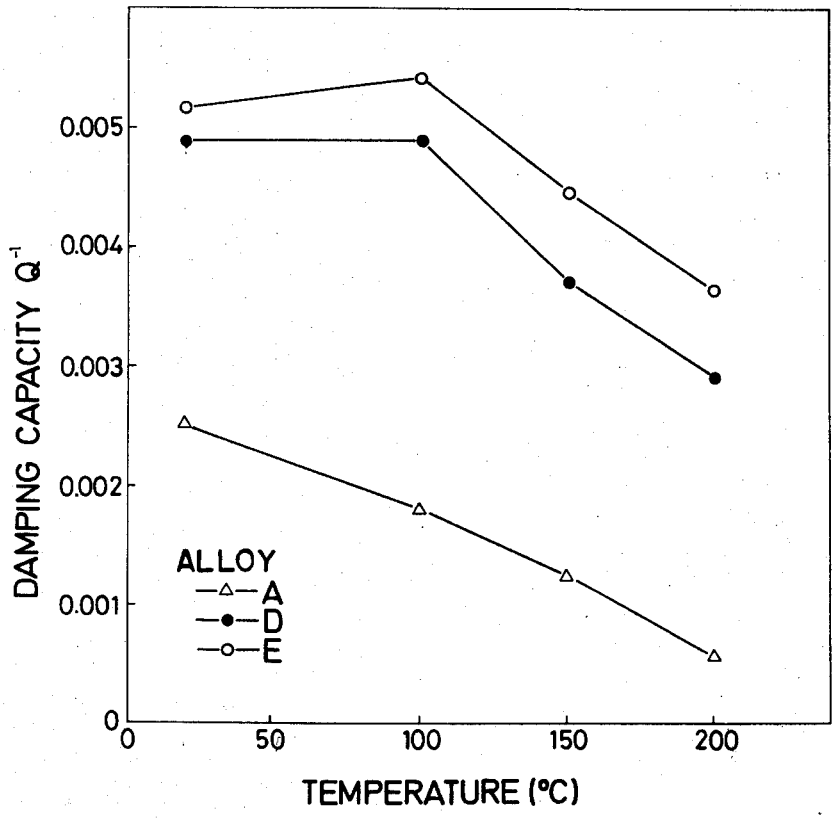
FIG. 1 is a graph showing the thermal stabilities of damping capacities of alloys according to the invention and of the prior art.

The titanium alloys of the compositions given in Table 1 were melted, in amounts of 150 grams each, by the button melting technique, and were formed to pieces, 20 mm square in cross section, by $\beta$ forging and then to 10 mm × 15 mm square test specimens by $\alpha+\beta$ forging, for tests now to be described. These specimens were rapidly cooled (water quenched) from the solution treatment temperatures in Table 2, and the cold specimens were examined for their internal-friction and mechanical properties.

Table 1

| | Chemical composition (wt%) | | | | | | | | | |
|---|---|---|---|---|---|---|---|---|---|---|
| Alloy | Al | V | Mo | Fe | C | O | N | H | Ti | Remarks |
| A | 5.86 | 4.19 | — | 0.216 | 0.013 | 0.167 | 0.0047 | 0.0295 | bal. | Conventional |
| B | 5.84 | 4.22 | 0.64 | 0.231 | 0.017 | 0.152 | 0.0053 | 0.0220 | bal. | Referential |
| C | 5.68 | 4.17 | 1.52 | 0.265 | 0.015 | 0.147 | 0.0038 | 0.0147 | bal. | Invention |

Table 1-continued

| Alloy | Chemical composition (wt%) | | | | | | | | | |
|---|---|---|---|---|---|---|---|---|---|---|
| | Al | V | Mo | Fe | C | O | N | H | Ti | Remarks |
| D | 5.88 | 4.32 | 2.59 | 0.241 | 0.018 | 0.181 | 0.0090 | 0.0273 | bal. | Invention |
| E | 5.81 | 4.04 | 4.03 | 0.262 | 0.016 | 0.166 | 0.0077 | 0.0245 | bal. | Invention |
| F | 5.76 | 4.02 | 5.41 | 0.268 | 0.017 | 0.162 | 0.0070 | 0.0282 | bal. | Referential |
| G | 5.85 | 2.21 | 4.65 | 0.255 | 0.016 | 0.153 | 0.0090 | 0.0195 | bal. | Invention |
| H | 5.83 | 4.06 | 3.36 | 0.273 | 0.014 | 0.175 | 0.0068 | 0.0312 | bal. | Invention |

Table 2

| Alloy | $\beta$ transformation point (° C) | Solution treatment temp (° C) | Damping capacity ($Q^{-1}$) | Remarks |
|---|---|---|---|---|
| A | 965 | 785 | $2.53 \times 10^{-3}$ | Conventional |
| B | 940 | 840 | $2.51 \times 10^{-3}$ | Referential |
| C | 925 | 875 | $4.20 \times 10^{3}$ | Invention |
| D | 915 | 865 | $4.88 \times 10^{-3}$ | Invention |
| E | 905 | 855 | $5.12 \times 10^{-3}$ | Invention |
| F | 895 | 845 | $4.72 \times 10^{-3}$ | Referential |
| G | 940 | 890 | $4.83 \times 10^{-3}$ | Invention |
| H | 910 | 860 | $5.00 \times 10^{-3}$ | Invention |

The internal frictions were determined using an internal-friction measuring instrument of the transverse vibration type, with a vibration damping capacity in $Q^{-1}$. The test specimens were 2 mm thick, 10 mm wide, and 90 mm long each. Table 2 also shows the internal frictions of the alloy specimens so measured.

As can be seen from these tables, the alloy B that contained 0.64% Mo exhibited almost no beneficial effect of Mo addition as compared with the existing standard alloy of the Ti-6Al-4V composition (alloy A). It will be seen, however, that the alloys C through H that contained larger percentages of Mo were substantially improved in internal friction over the conventional alloy A.

The alloys D and G, whose combined V and Mo contents approximately equal 6.9%, have also substantially the same internal friction values, as shown in Table 2. Because of the similarity in action, V and Mo have often been added to titanium-base alloys, and a concept of V equivalent ($1 \times V(\%) + 1.3 \times Mo(\%)$) has been proposed as quantitative means for evaluating the effect of composite addition. These are generally consistent with the test results tabulated above, indicating that, the combined percentage of V and Mo contained being constant, the internal friction will remain unchanged. In other words, the combined percentage of V and Mo being constant, the same effect of improving the internal friction will be imparted to the titanium alloy. To be more specific, the test results summarized in Table 2 clearly show that marked improvements in internal friction are possible when the combined percentage of V and Mo contained is greater than or equal to 5%, preferably greater than or equal to 6%.

The test results of alloy B indicate that the Mo content should be greater than or equal to one percent. The same applies to the V content since V and Mo are equivalent both qualitatively and quantitatively and the addition of both elements, in amounts of not less than one percent each, is expected to give a synergetically favorable effect.

Thermal stabilities of some alloys in Table 1 will now be considered. The alloys A, D, and E were heated and maintained at temperatures of 100°, 150°, and 200° C. for one hour each, followed by air cooling, and their internal friction values were determined at room temperature. FIG. 1 gives a summary of the results. The temperature levels at which the specimens were kept for one-hour periods are plotted as abscissa. It will be clear from the graph that the alloys D and E according to this invention have excellent thermal stability, with high internal friction values even at elevated temperatures as compared with the conventional standard alloy of the Ti-6Al-4V composition (alloy A). The alloy E is by far superior with high absolute values of internal friction and with a low rate of decrease in the internal friction at high temperatures.

As will be appreciated from the foregoing, the combined addition of V and Mo improves the internal friction of a titanium alloy more markedly than would be expected from the application of the concept of V equivalent, and affords a titanium alloy having excellent thermal stability.

It should be noted here that, according to general belief, an excess of $\beta$ stabilizers not only increases the density and decreases the specific strength of the alloy but also lowers the Young's modulus and reduces the ductility and toughness of the alloy. The percentages of such elements must, therefore, be within the ranges which will increase the internal friction of the resulting alloy without materially affecting its Young's modulus, ductility, and toughness. In line with this, the mechanical properties of the alloys in Table 1 were investigated. Table 3 summarizes the results.

As can be seen from Table 3, there were no appreciable differences in the yield strength (0.2% offset) and tensile strength values of the test alloys, although both values tended to decrease with an increase in the Mo content. The alloy F that contained 5.41% Mo gave much lower values in elongation during a tension test and in 2 mm V-notch Charpy impact test than the rest of alloys, indicating decreases in ductility, toughness, and Young's modulus.

Table 3

| Alloy | Yield Strength (0.2% offset) (kg/mm$^2$) | Tensile strength (kg/mm$^2$) | Elongation (%) | 2mm V-notch charpy impact value (kg-m/cm$^2$) | Young's modulus (kg/mm$^2$) | Remarks |
|---|---|---|---|---|---|---|
| A | 76.9 | 100.6 | 17.2 | 2.7 | 10,500 | Conventional |
| B | 77.2 | 100.3 | 12.2 | 2.4 | 10,400 | Referential |
| C | 74.5 | 99.2 | 13.6 | 2.6 | 10,000 | Invention |
| D | 75.3 | 96.2 | 12.5 | 2.1 | 9,100 | Invention |
| E | 74.5 | 94.1 | 10.6 | 2.2 | 8,800 | Invention |
| F | 72.3 | 86.4 | 7.6 | 0.7 | 7,700 | Referential |
| G | 76.0 | 97.0 | 11.5 | 2.1 | 9,200 | Invention |
| H | 75.1 | 96.0 | 12.0 | 2.1 | 9,200 | Invention |

Thus, in order to attain increased internal friction without having any deleterious effect upon its Young's modulus, ductility, and toughness, the alloy should not contain more than 5% Mo. By the same token, V which acts like Mo should not account for more than 5%, of the alloy composition.

In the usual manner the amount of Al should be from 5.5–6.75%, that is, the proportion required to give added strength without embrittling the resulting alloy.

The alloys A, C, D, and H in Table 1 were rapidly cooled (water quenched) from predetermined temperatures within the $\alpha+\beta$ and $\beta$ phase ranges, and their internal friction values were determined. The instrument employed for the measurements and the shape of the test specimens were the same as already described.

Figure 2:
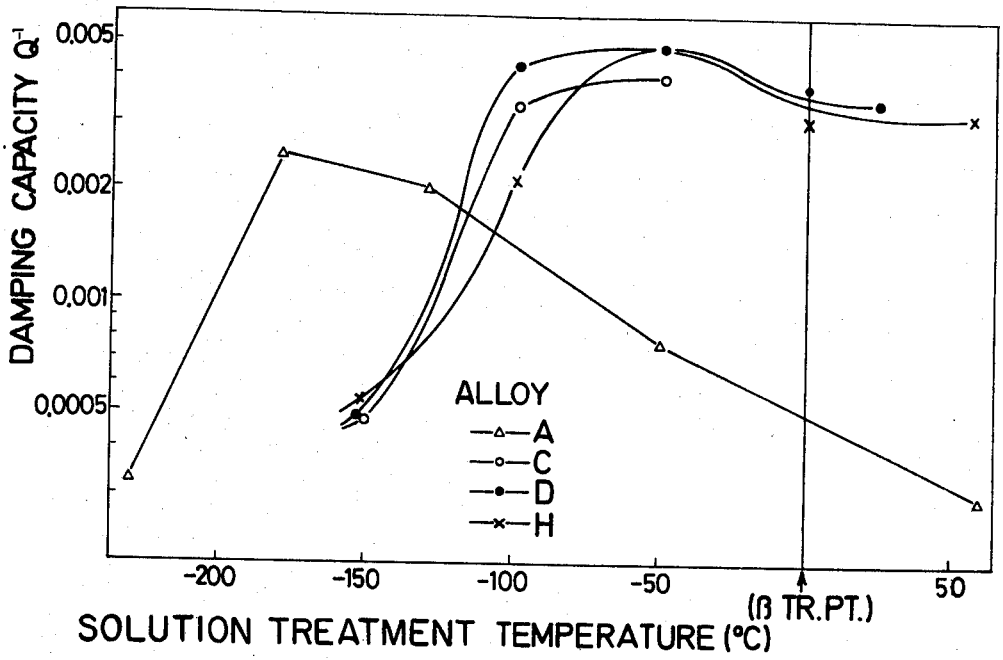
FIG. 2 is a graph showing the relations between the damping capacities of the alloys of the invention and of the prior art and solution treatment temperatures.

In FIG. 2 are plotted the data indicating the relations between the solution treatment temperature and internal friction values of the alloys A, C, D, and H. The internal friction of the conventional Ti-6Al-4V alloy (A) reaches its peak where the solution treatment temperature is in the neighborhood of the point lower than the $\beta$ transformation point of the alloy by 180° C. It was also confirmed that, if the solution treatment temperature exceeds the $\beta$ transformation point, the internal friction value will be very small. This is referred to in the specification of our Japanese Patent Application No. 3072/74.

FIG. 2 also shows that, with the alloys C, D, and H according to the invention, the internal friction values are very high where their solution treatment temperatures are lower than their $\beta$ transformation points by 100° C., but they decrease where the temperatures are lower by 150° C.

Figure 3:
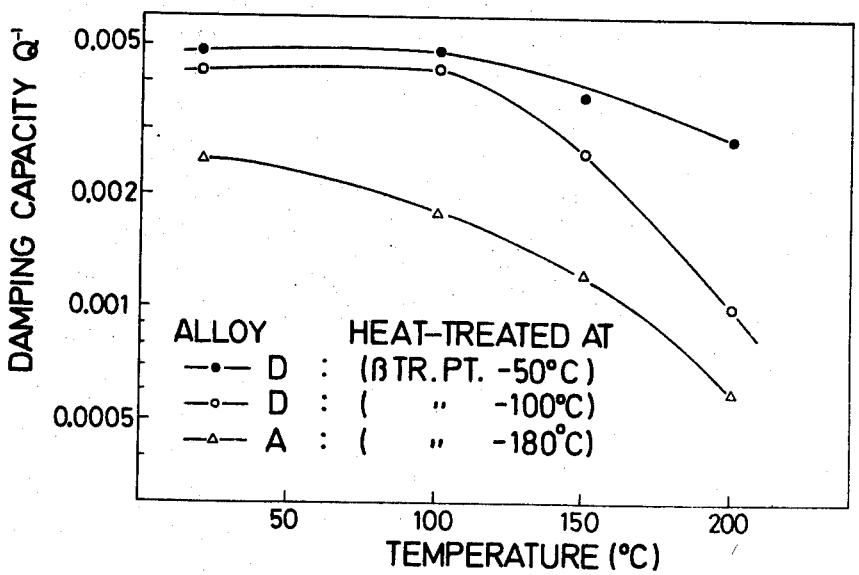
FIG. 3 is a graph similar to FIG. 1, but indicating the thermal stabilities after some aging treatments.

FIG. 3 shows the changes of internal friction values of the alloys A and D with aging after rapid cooling, that is, the thermal stabilities of those alloys tested. The temperatures at which the alloys to be heat-treated were kept for test periods are plotted horizontally. The measurements were taken by maintaining the alloys at respective temperatures for one-hour periods and then air cooling the same. In this graph the expression "Alloy D; Heat-treated at ($\beta$ transformation point — 50° C.)", for example, means that the alloy D was rapidly cooled from a temperature which was lower than the $\beta$ transformation point of that alloy by 50° C.

As will be understood from FIG. 3, the conventional Ti-6Al-4V alloy (A), having been heat-treated at the temperature that raises its internal friction to a maximum, that is, at a temperature lower than the $\beta$ transformation point of that alloy by 180° C., will show a sharp drop of its internal friction to less than 0.001 upon heating at 200° C. for the one-hour period. In contrast with this, the alloy D of the invention exhibits an internal friction value of over 0.001 even when water quenched from the lower of the two solution treatment temperatures, that is, at a temperature lower than its $\beta$ transformation point by 100° C. The alloy when solution treated at the higher temperature, that is, at a temperature lower than its $\beta$ transformation point by 50° C., shows practically no decrease in the internal friction, indicating an excellent thermal stability.

From the results discussed above, it will be understood that the alloy according to the invention will attain very high internal friction and excellent thermal stability upon rapid cooling from a solution treatment temperature which is not lower than 125° C. below the $\beta$ transformation point of that particular alloy. Within this solution treatment temperature range, the higher the temperature, the greater the thermal stability of the internal friction will be.

As has been described in detail, the present invention provides a titanium alloy with a high internal friction and excellent thermal stability, and also a method of heat treatments for further improving the internal friction and its thermal stability. The alloy of the invention thus heat-treated is useful for such applications as the rotating blades of turbines and the like where generation of vibrations would be otherwise inevitable.

What is claimed is:

1. A heat-treated titanium alloy with a high internal friction suitable for rotating blades of turbomachines and consisting essentially of, by weight, 5.5–6.75% Al, 1–5% V, 1–5% Mo, V plus Mo being greater than 6%, and the balance being Ti, the alloy having been solution heat treated at a temperature not lower than 125° C. below the $\beta$ transformation point of the alloy, the alloy having a minimum damping capacity of about $5 \times 10^{-3}$.

2. A method of solution heat-treating a titanium alloy with a high internal friction suitable for rotating blades of turbomachines, which comprises heating and maintaining a titanium alloy consisting essentially of, by weight, 5.5–6.75% Al, 1–5% V, 1–5% Mo, V plus Mo being greater than 6%, and the balance being Ti at a temperature not lower than 125° C. below the $\beta$ transformation point of the alloy for a predetermined period of time, and then rapidly cooling the same to produce an alloy having a minimum damping capacity of about $5 \times 10^{-3}$.

* * * * *